US006681427B2

(12) United States Patent
Anderson et al.

(10) Patent No.: US 6,681,427 B2
(45) Date of Patent: Jan. 27, 2004

(54) APPARATUS FOR IMPARTING CONTINUOUS MOTION TO A MATTRESS

(75) Inventors: Brenda K. Anderson, Ada, OK (US); James A. Blackwell, Shreveport, LA (US)

(73) Assignee: Anderson Bio-Bed, Incorporated, Ada, OK (US)

( * ) Notice: Subject to any disclaimer, the term of this patent is extended or adjusted under 35 U.S.C. 154(b) by 11 days.

(21) Appl. No.: 10/173,793

(22) Filed: Jun. 18, 2002

(65) Prior Publication Data

US 2003/0014822 A1 Jan. 23, 2003

Related U.S. Application Data

(60) Provisional application No. 60/299,350, filed on Jun. 19, 2001.

(51) Int. Cl.[7] ..... A47C 27/10; A61G 7/057

(52) U.S. Cl. ..... 5/713; 5/740

(58) Field of Search ..... 5/713, 710, 653, 5/654, 740, 933

(56) References Cited

U.S. PATENT DOCUMENTS

| | | | | |
|---|---|---|---|---|
| 3,008,465 A | * | 11/1961 | Gal | 5/713 |
| 3,638,642 A | | 2/1972 | Heflin, Sr. | |
| 3,689,948 A | | 9/1972 | Graves et al. | |
| 3,926,177 A | | 12/1975 | Hardway, Jr. et al. | |
| 4,134,168 A | | 1/1979 | Guigan | |
| 4,220,143 A | | 9/1980 | Cummins et al. | |
| 4,381,788 A | | 5/1983 | Douglas | |
| 4,494,553 A | | 1/1985 | Sciarra et al. | |
| 4,509,527 A | | 4/1985 | Fraden | |
| 4,788,730 A | | 12/1988 | Bexton | |
| 4,799,276 A | * | 1/1989 | Kadish | 5/933 |
| 4,945,588 A | | 8/1990 | Cassidy et al. | |
| 5,003,654 A | | 4/1991 | Vrzalik | |
| 5,170,522 A | | 12/1992 | Walker | |
| 5,201,780 A | | 4/1993 | Dinsmoor, III et al. | |
| 5,353,012 A | | 10/1994 | Barham et al. | |
| 5,421,874 A | | 6/1995 | Pearce | |
| 5,513,400 A | | 5/1996 | Turner | |
| 5,540,651 A | | 7/1996 | Risch et al. | |
| 5,549,743 A | | 8/1996 | Pearce | |
| 5,586,346 A | | 12/1996 | Stacy et al. | |
| 5,586,348 A | * | 12/1996 | Toivio et al. | 5/713 |
| 5,611,096 A | | 3/1997 | Bartlett et al. | |
| 5,626,657 A | | 5/1997 | Pearce | |
| 5,630,238 A | | 5/1997 | Weismiller et al. | |
| 5,636,395 A | | 6/1997 | Serda | |
| 5,652,985 A | | 8/1997 | Wilkinson et al. | |
| 5,745,942 A | | 5/1998 | Wilkerson | |
| 5,749,111 A | | 5/1998 | Pearce | |
| 5,802,645 A | | 9/1998 | Vrzalik | |
| 5,836,027 A | | 11/1998 | Leventhal et al. | |
| 5,881,409 A | | 3/1999 | Pearce | |
| 5,882,300 A | | 3/1999 | Malinouskas et al. | |
| 5,956,787 A | | 9/1999 | James et al. | |
| 5,966,763 A | | 10/1999 | Thomas et al. | |
| 5,983,429 A | | 11/1999 | Stacy et al. | |
| 6,017,307 A | | 1/2000 | Raines | |
| 6,058,538 A | | 5/2000 | Chapman et al. | |
| 6,085,372 A | | 7/2000 | James et al. | |
| 6,115,860 A | | 9/2000 | Vrzalik | |
| 6,163,908 A | | 12/2000 | Vrzalik | |
| 6,223,369 B1 | * | 5/2001 | Maier et al. | 5/713 |
| 2001/0034908 A1 | * | 11/2001 | Daly | 5/713 |

FOREIGN PATENT DOCUMENTS

| | | | | |
|---|---|---|---|---|
| GB | 959103 | * | 9/1964 | 5/709 |

* cited by examiner

*Primary Examiner*—Alexander Grosz
(74) *Attorney, Agent, or Firm*—Geoffrey A. Mantooth; Arthur F. Zobal

(57) ABSTRACT

The apparatus includes an elastic layer for supporting a person. A plurality of rows of expandable and retractable tubes are embedded in the elastic layer. A source of compressed air and a control system are provided for sequentially injecting and releasing air into and from a first set of alternate tubes and then into and from a second set of alternate tubes for imparting continuous motion to the elastic layer.

12 Claims, 9 Drawing Sheets

PRESSURE TUBES IN MOTION, IN GEL/POLY MATRIX

CONTINUOUS MOTION MATTRESS ASSEMBLY

CONTINUOUS MOTION MATTRESS ASSEMBLY

APPARATUS FOR IMPARTING CONTINUOUS MOTION TO A MATTRESS

SPECIFICATION

This application claims the benefit of U.S. Provisional Patent Application No. 60/299,350, filed Jun. 19, 2001.

BACKGROUND OF THE INVENTION

1. Field of the Invention

The invention relates to an apparatus for imparting continuous motion to a mattress for supporting a bed-ridden patient.

2. Description of the Prior Art

Mattresses have been produced to prevent decubitus ulcers (bed sores) from forming on bed-ridden patents due to the lack of movement and circulation of the patient, however, the known mattresses do not operate effectively to perform their intended function and/or they are difficult to operate.

SUMMARY OF THE INVENTION

It is an object of the invention to provide a new and useful mattress and system for effectively preventing bed-sores from forming on patients.

The mattress comprises an elastic layer with a system for imparting continuous motion to the support layer.

The system comprises a plurality of rows of spaced apart expandable and retractable tubes embedded in the elastic layer with means for expanding and retracting sequentially a first set of alternate rows of tubes and then a second set of alternate rows of tubes to impart motion to the elastic layer.

In a further aspect, a source of gas under pressure and an exhaust means is provided. A control means sequentially connects a first set of alternate rows of tubes to the source of gas and then to the exhaust means and a second set of alternate rows of tubes to the source of gas and then to the exhaust system for exhausting and retracting the first set of tubes and then the second set of tubes. This sequence will be controlled by zones or as a complete mattress.

BRIEF DESCRIPTION OF THE DRAWINGS

In FIGS. 1 and 2, the pressure tubes are shown above the support layer, however, they will be molded into the support layer near its upper surface as seen in FIG. 3.

DESCRIPTION OF THE PREFERRED EMBODIMENTS

Figure 1:
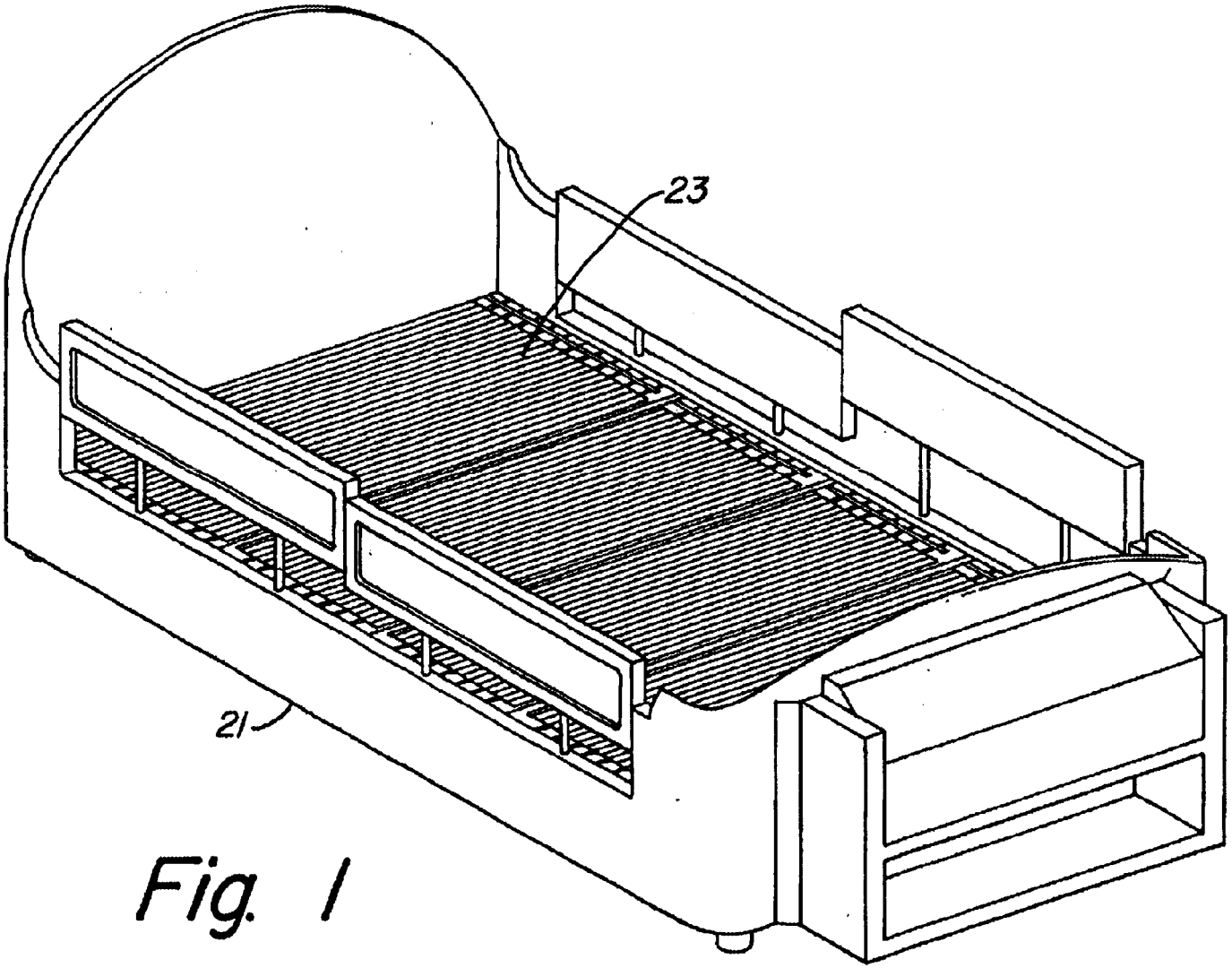
FIG. 1 illustrates the mattress of the invention on a bed frame.

Referring now to the drawings there is illustrated a bed frame 21 that supports the mattress 23 of the invention for supporting a person. The mattress is a two layer mattress comprising an upper layer 25 and a lower layer 27. The layer 25 preferably is formed of a gel/poly matrix with pressure tubes 31 molded into the mattress, The gel/poly matrix may be an elastic or visco-elasfic material with a shore A durometer hardness range of from shore A0 to A40. The pressure tubes 31 may be formed of a low density/low molecular weight polyethylene or plastic (slightly higher hardness and higher density that the gel/poly matrix) extruded tube upper and lower halves.

The lower layer 27 preferably is of the high density polyurethane foam that will be both supportive and flexible. The high density polyurethane foam will be permanently bonded to the gel/poly matrix with an anti-microbial, bacteria resistant, fluid proof, flame retardant, stain and tear resistant, non-allergenic fabric cover. Both layers 25 and 27 are shown in FIG. 1 as supported by the bed frame 21.

The tubes 31 are molded or embedded in the layer 25 in spaced apart parallel rows extending across the width of the layer 25 and located near the top surface 25T of the layer 25.

Figure 5:
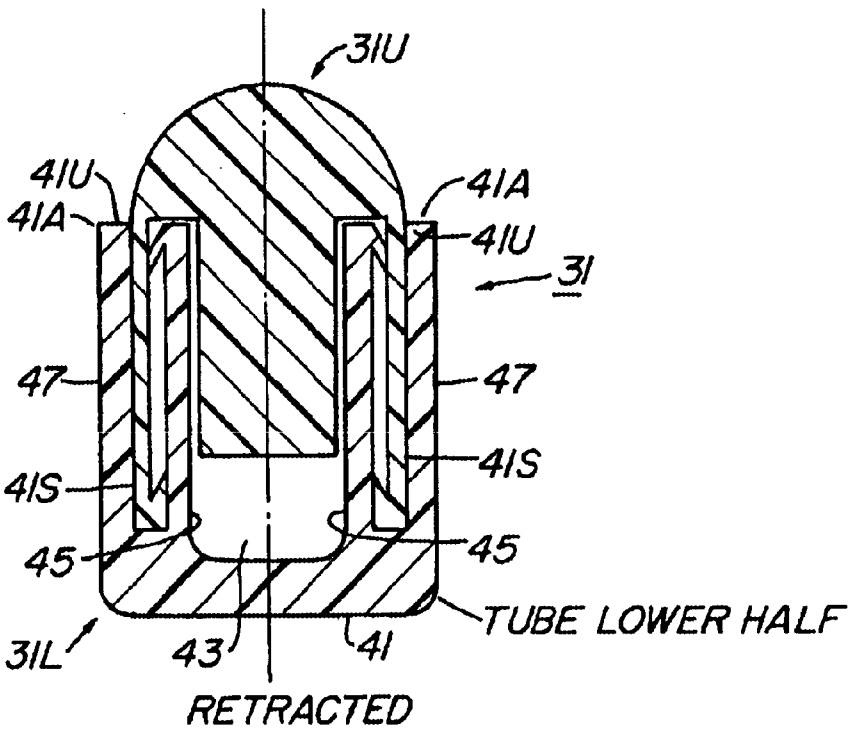
FIGS. 5 and 6 are cross-sectional views of one of the pressure tubes of the mattress in retracted and expanded positions respectively.
Figure 6:
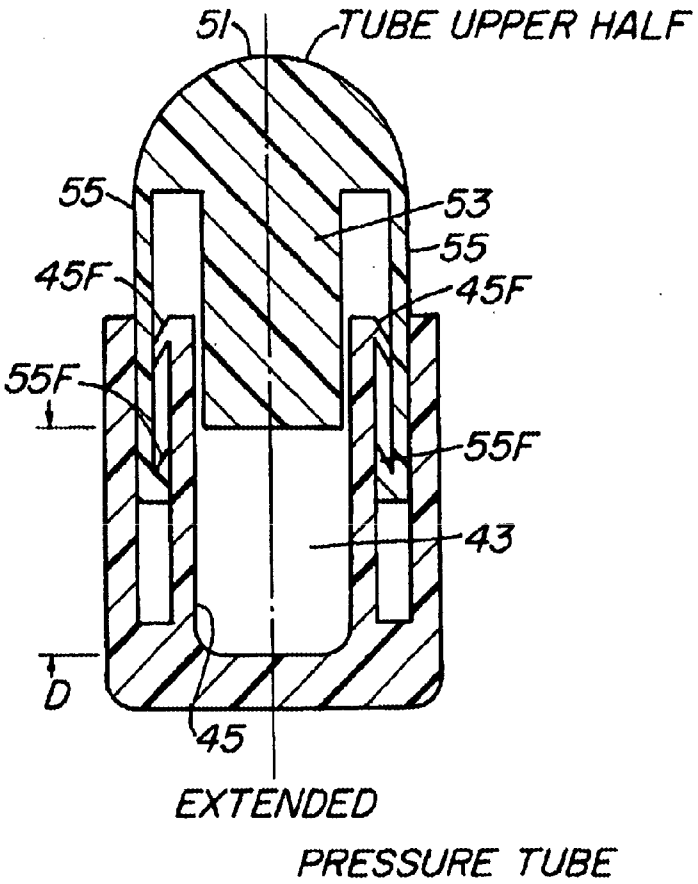
Figure 7:
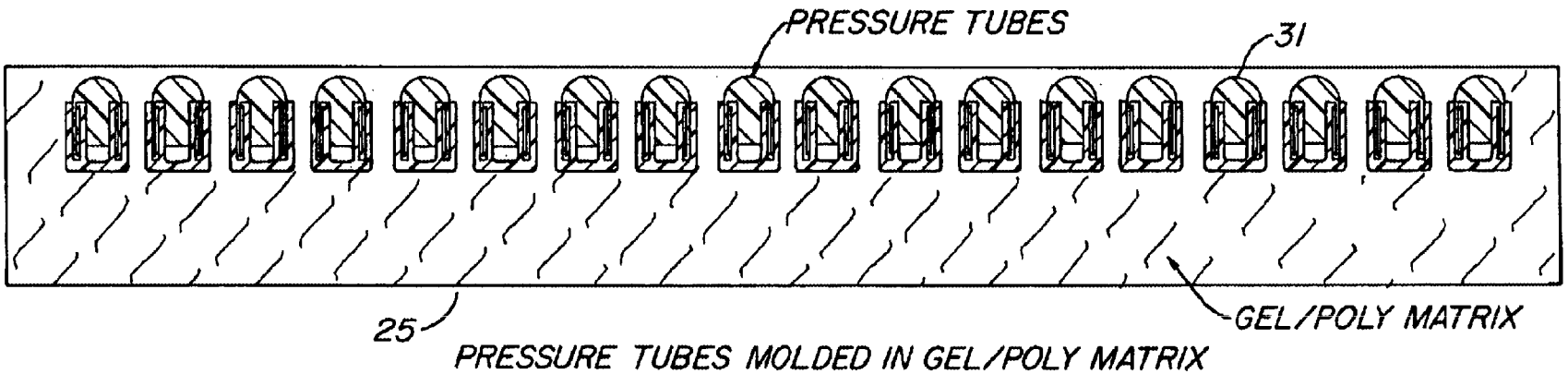
FIG. 7 is a cross-sectional view of a section of the pressure tubes of the mattress with the pressure tubes in retracted positions.
Figure 8:
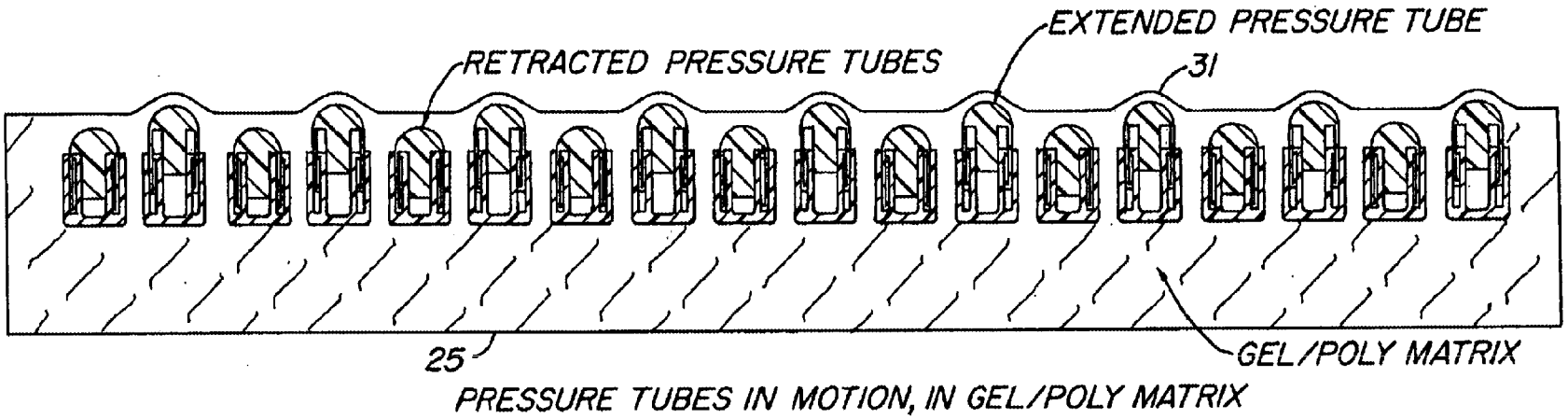
FIG. 8 is a cross-sectional view of a section of the pressure tubes of the mattress with alternate pressure tubes in expanded positions.
Figure 9:
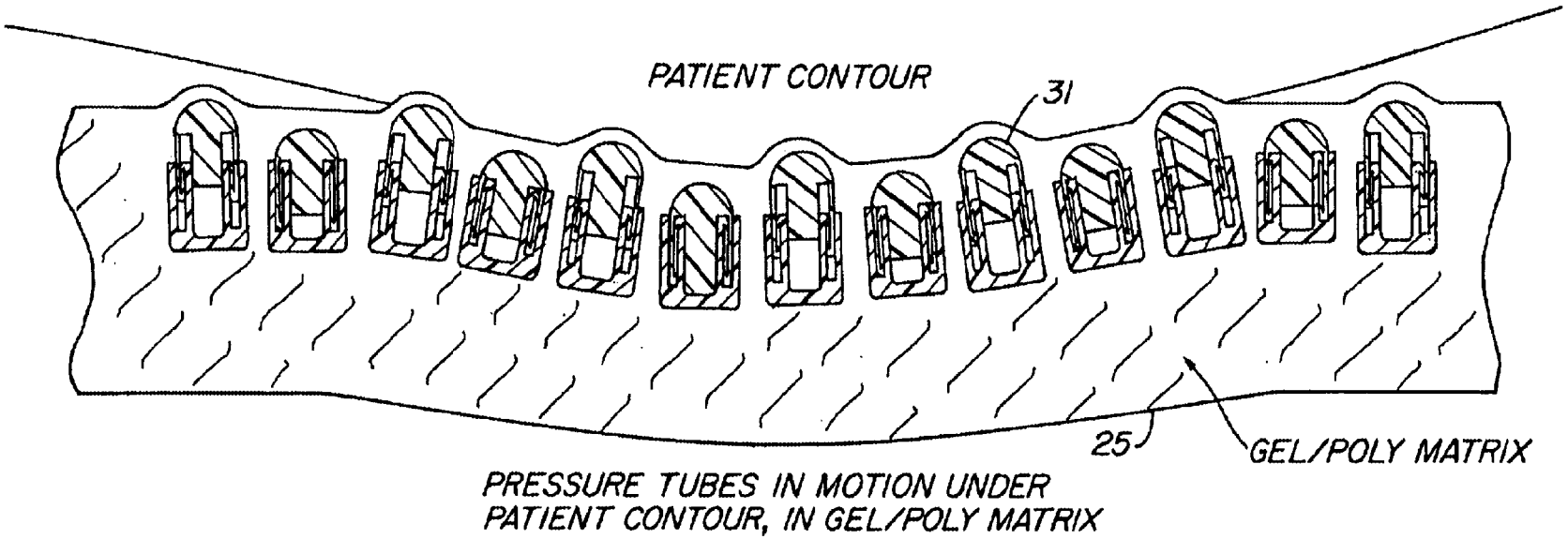
FIG. 9 is a cross-sectional view of part of the pressure tubes in expanded positions with the mattress shaped by a patient's contour.

Referring to FIGS. 5 and 6, each of the tubes 31 comprises a lower tube half 31L and an upper tube half 31U. The lower half 31L is U-shaped in cross-section having a base 41 and thin side walls 41 A defining a central space or chamber 43 between the two walls. Each wall 41A has a slot 41S formed therein from its upper edge 41U defining two walls 45 and 47. Each wall 45 at its upper end has a downward extending flange 45F. In FIG. 6, the dimension D may be equal to a 0.10" to 0.40".

The upper half 31U has a rounded upper portion 51, a central wall 53 slidable in opening 43 and two side walls 55 slidable in the two slots 41S. Each wall 55 has an upward extending flange 55F at its lower end. Although not shown, suitable seals will be provided between the walls 55 and 45 and 47.

In the retracted position, the flange ends of the walls 55 engage the bottoms of the slots 41 S as seen in FIG. 5. In the extended position, the upper half 31U moves up as shown in FIG. 6. The two pairs of flanges 45F and 55F will engages each other if the upper half 31U moves too high and prevent walls 55 from moving out of the slots 41S. The upper portion 31U of each pressure tube will be able to move upward from 0.10 to 0.40 of an inch relative to its lower portion 31L.

A gas which is preferably air is injected into the opening or chamber 43 to move the upper half 31U to its extended position and is withdrawn from the chamber 43 to move the upper half 3U to its retracted position. When this occurs motion is imparted to the plastic layer 25.

Figure 2:
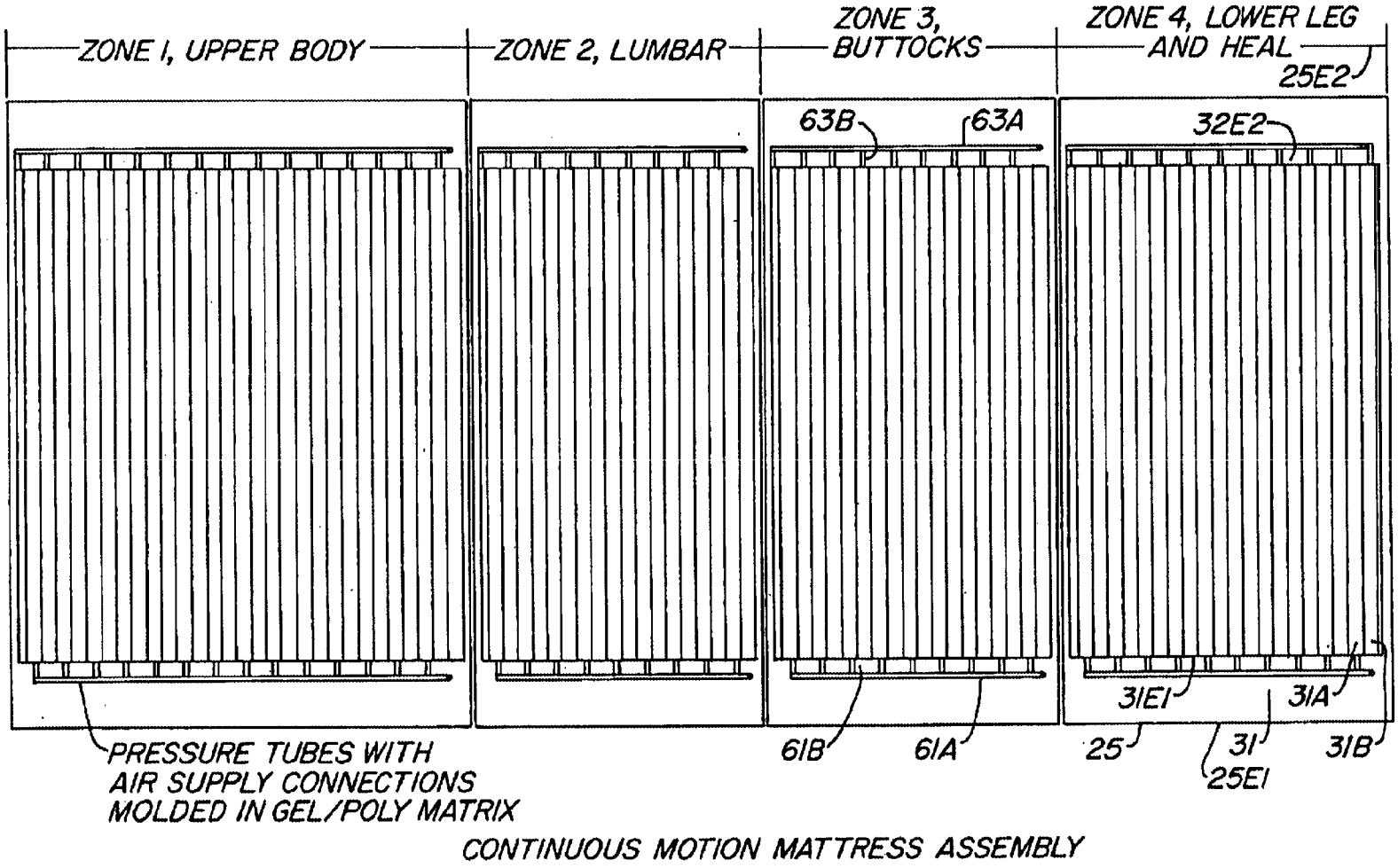
FIG. 2 is a top plan view of the expandable and retractable pressure tubes of the mattress of the invention.
Figure 12:
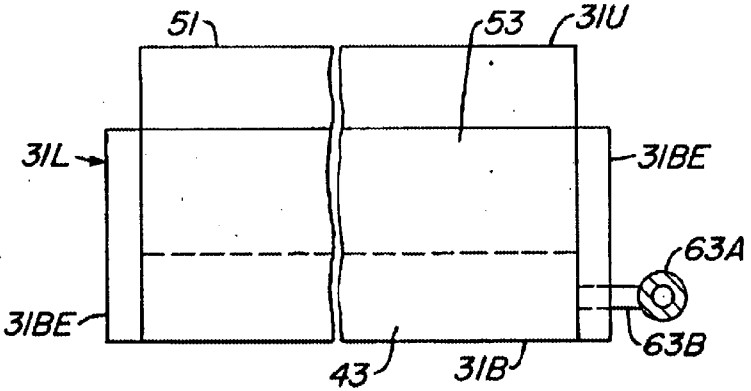
FIGS. 11 and 12 are enlarged side views of two of the pressure tubes of the mattress.
Figure 11:
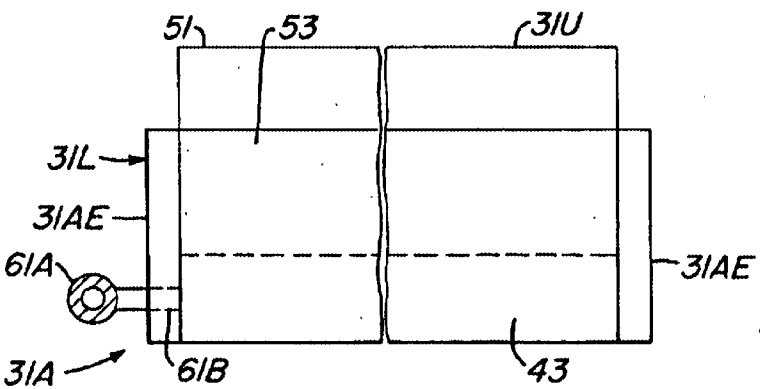

As seen in FIGS. 3, 7, 8, and 9, the tubes 31 are located in spaced apart rows. In FIG. 2, the rows of tubes are shown engaging each other, however, adjacent rows of tubes 31 will be spaced apart as shown in FIGS. 3, 7, 8, and 9. Adjacent pressure tubes 31 may be located 1"–3" apart. As shown in FIGS. 1, 2, and 4 the ends 31E1 and 32E2 of each pressure tube 31 will be spaced inward from the edges 25E1 and 25E2 of the layer 25 and flexible plastic tubes 61A and 63A will extend through the layer 25 parallel to its edges 25E1 and 25E2. Small flexible plastic tubes 61B and 63B extend from tubes 61A and 63A into the chambers 43 of the appropriate tubes 31. The tubes 61A and 63A then extends downward through layers 25 and 27. In the embodiment disclosed, tube 61A is located on one side of the mattress and flexible plastic tubes 61B extend into the chambers 43 of alternate tubes 31A and flexible plastic tube 63A is located on the other side of the mattress and flexible plastic tubes 63B extend into alternate tubes 31B. Thus tube 61A is in fluid communication with the chambers 43 of alternate tubes 31A and tube 63A is in fluid communication wit the chambers 43 of alternate tubes 31B. The lower halves 31L of tubes 31A and 31B will have end enclosures or walls 31AE and 31BE through which the tube connections 61B and 63B extend respectively as shown in FIGS. 11 and 12.

In operation of the system, air is injected and exhausted from the chamber 43 of tubes 31A and then injected and exhausted from the chambers 43 of tubes 31A. This is done on a continuous basis to impart continuous motion to the layer 25.

The tube upper half 31U will transfer motion into the gel/poly matrix 25, which in turn will create movement and maintain circulation in tissue of the patient. The tube lower half 31L will direct approximately 80% of the motion energy of the compressed air vertically into the upper half 31U of the tube 31. The remaining 20% of motion energy will be absorbed into the gel/poly matrix.

Figure 3:
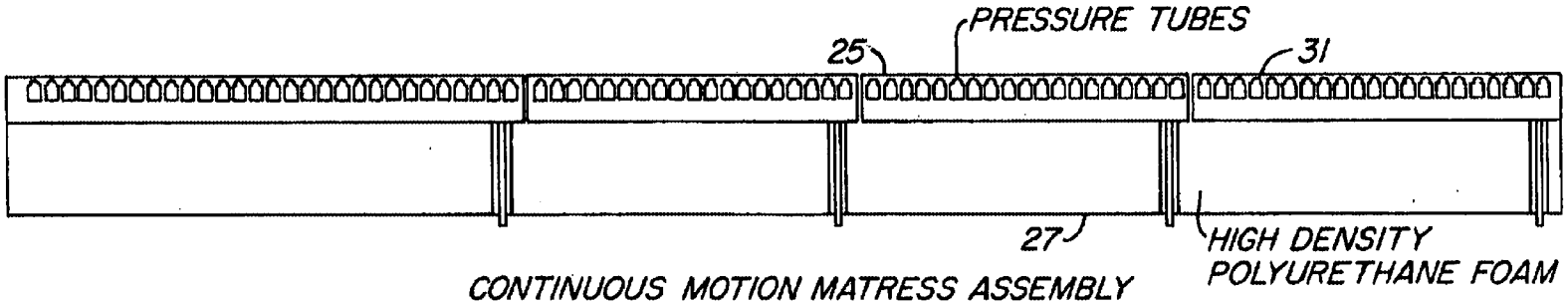
FIG. 3 is a side view of the mattress assembly with the pressure tubes depicted in the top layer near its upper surface.
Figure 4:
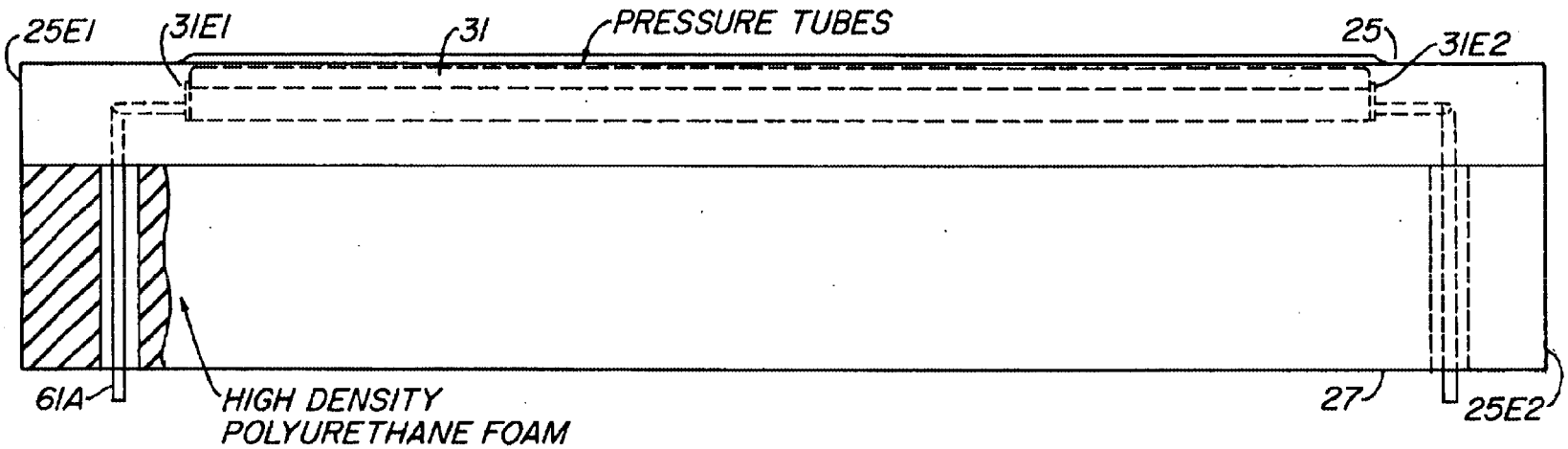
FIG. 4 is a view of one of the pressure tubes of the mattress as seen from the end of the mattress.

In the preferred embodiment, as shown in FIGS. 2 and 3, the length of the mattress 25, 27 is divided into four zones, an upper body zone, a lumbar zone, a buttocks zone, and a lower leg and heel zone.

Approximately, twenty eight tubes 31 are located in the upper body zone and eighteen tubes 31 are located in each of the lumbar, buttocks, and lower leg and heel zone. These numbers, however, may vary. In each zone, tubes 61A are coupled to the chambers 43 of alternate tubes 31A and tubes 61B are coupled to the chambers 43 of alternate tubes 31B.

The four zones will permit angle and position adjustability of the mattress and also provide the option of independent control of continuous motion in each zone. Continuous motion will be controlled by an air supply system to be discussed subsequently. The air supply system will provide 15 to 40 psig at 15 to 60 scfm compressed air supply to the expandable tubes. High/low pressure switch control will provide redundant over pressure protection and control pressure in the expandable tubes.

Figure 10:
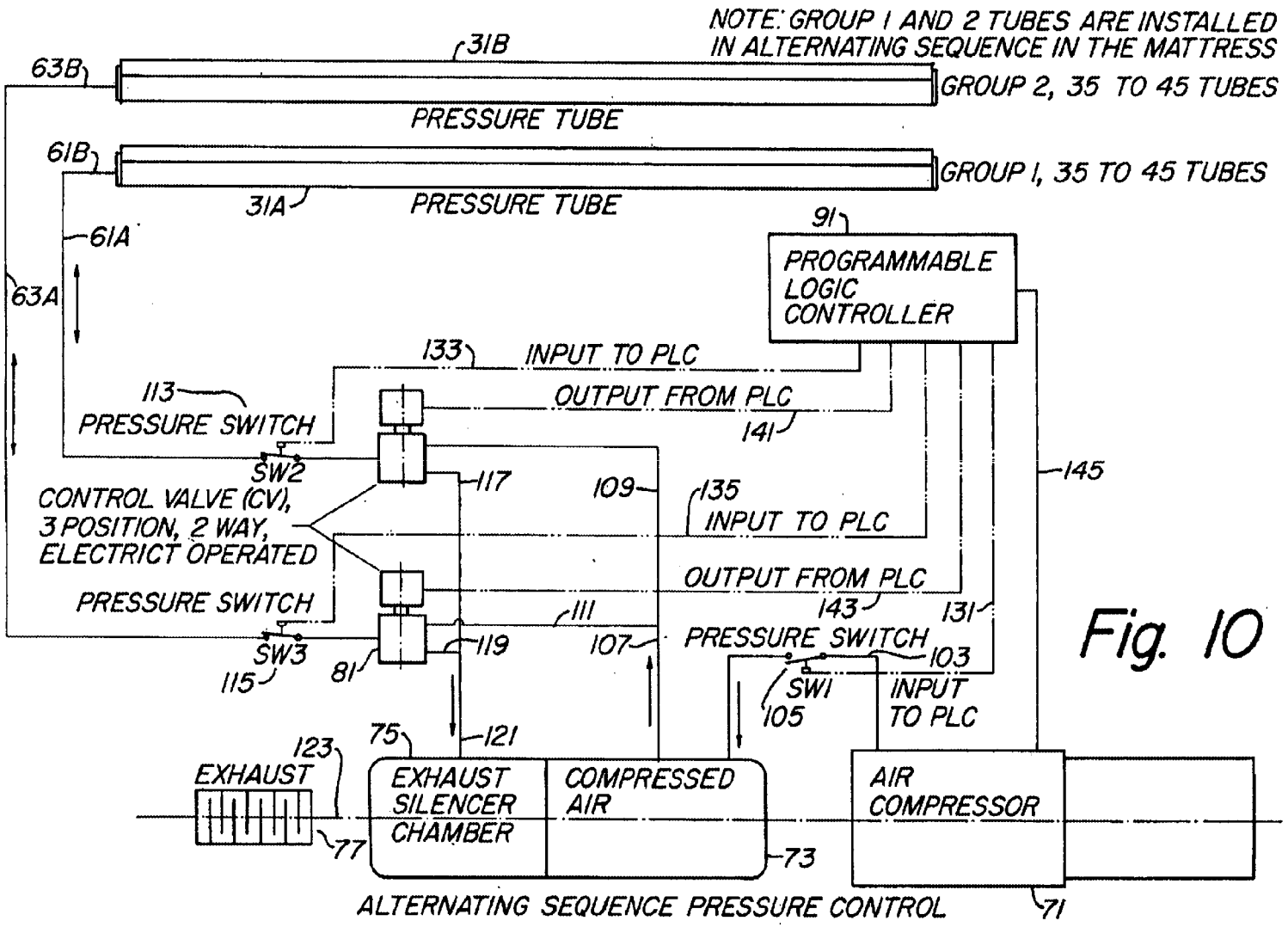
FIG. 10 is a block diagram of the air supply system of the invention.

Referring now to FIG. 10, there will be descried the air supply system for imparting motion to the mattress.

The system comprises an electrically operated air compressor 71, a compressed air storage tank 73, an exhaust silencer chamber 75, an exhaust 77, two three way electrically actuated valves 79 and 81 and a programmable logic controller 91.

Air from the compressor 71, is applied to the storage tank 73 by way of a tube 103 which includes a pressure switch 105. Compressed air from the tank 73 is applied to two three way valves 79 and 81 by way of tube 107 and tubes 109 and 111. An air output of the valve 79 is applied to the tube 61A by way of a pressure switch 113 and an air output of the valve 81 is applied to tube 61B by way of a pressure switch 115. Air outputs of the valves 79 and 81 are applied to the exhaust chamber silencer 75 by way of tubes 117 and 119 respectively and then by way of tube 121. The air output of silencer 75 is applied to the exhaust 77 by way of tube 123.

Switches 105, 113, and 115 have electrical outputs representative of pressure applied to the PLC 91 by way of leads 131, 133, and 135. The PLC has output leads 141, 143, and 145 coupled to the valve 79, valve 81, and the compressor 71 respectively.

In operation, the PLC receives inputs from pressure switches 105, 113, and 115 by way of leads 131, 133, and 135. The compressor 71 is turned on and the PLC 91 senses the pressure at each of switches 105, 113, and 115. The PLC turns the compressor 71 on or off to maintain the pressure at switch 105 at about 40 psig. The switches 113 and 115 are adjustable to provide a pressure of 15–40 psig at these points and provide inputs to the PLC when the pressure at these points are at the pressure selected. The PLC controls valve 79 to apply air pressure to tubes 31A and then exhausts these tubes to units 75 and 77 and then controls valve 81 to apply air pressure to tubes 31B and then exhaust these tubes to exhaust units 75 and 77. A control timer in the PLC will alternate air flow from tubes 3 1A to tubes 31B at 1 to 3 second pressure dwell. The PLC 91 will control the valves 79 and 81 such that each of tubes 31A and 31B will have a frequency of expansion and retraction of 3 to 10 seconds and pressure hold duration of 1 to 3 seconds.

What is claim is:

1. A mattress support system for a person, comprising:

an elastic layer for supporting a person, a plurality of spaced apart expandable and retractable first tubes embedded in said layer, a plurality of spaced apart expandable and retractable second tubes embedded in said layer, each of said first tubes being spaced from each of said second tubes, each of said first and second tubes having a first portion and a second portion, with the first portion and the second portion forming a chamber therebetween, the first portion capable of moving with respect to the second portion as the tubes expand and refract, the first and second portions being independent and distinct from each other, a source of gas under pressure, an exhaust means, a plurality of first conduit means coupled to said chambers of said plurality of first tubes respectively, a plurality of second conduit means coupled to said chambers of said plurality of second tubes respectively, first valve means for coupling said source of gas to said plurality of first conduit means and to said exhaust means, second valve means for coupling said source of gas to said plurality of second conduit means and to said exhaust means, control means coupled to said first and second valve means for alternately coupling said source of gas to said plurality of first tubes and then to said exhaust means and to said plurality of second tubes and then to said exhaust means to alternately cause said plurality of first tubes to expand and retract and said plurality of second tubes to expand and retract to impart continuous motion to said support layer.

2. The mattress support system of claim 1, wherein:

each of said tubes is an elongated tube with all of said tubes being located in spaced apart rows, each of said tubes of said plurality of first tubes is located next to a tube of said plurality of second tubes.

3. The mattress support system of claim 1, wherein:

said elastic layer is formed of an elastic material.

4. The mattress support system of claim 1, wherein:

said elastic layer has a given length and a given width, each of said tubes is an elongated tube which extends across the width of said elastic layer.

5. A mattress support system for supporting a person comprising:

an elastic layer for supporting a person, a plurality of rows of spaced apart elongated tubes embedded in said layer with each of said tubes being expandable and retractable, each of said first and second tubes having a first portion and a second portion, with the first portion and the second portion forming a chamber therebetween, the first portion capable of moving with respect to the second portion as the tubes expand and retract, the first and second portions being independent and distinct from each other, expansion and retraction means for expanding and retracting sequentially a first set of alternate rows of tubes and a second set of alternate rows of tubes for imparting motion to said layer.

6. The mattress support system of claim 5, wherein:

said expansion and retraction means comprises, a source of gas under pressure, an exhaust means, control means for sequentially connecting a first set of alternate rows of tubes to said source and then to said exhaust means and a second set of alternate rows of tubes to said source and then to said exhaust means.

7. A method of imparting continuous motion to an elastic layer for supporting a person wherein said elastic layer has a plurality of spaced apart expandable and retractable first tubes embedded in said elastic layer and a plurality of spaced apart expandable and retractable second tubes embedded in said elastic layer with each of said first tubes being spaced from each of said second tubes, each of said first and second tubes having a first portion and a second portion, the first portion capable of moving with respect to the second portion as the tubes expand and retract, the first and second portions being independent and distinct from each other, comprising the steps of:

expanding and retracting said first tubes, expanding and retracting said second tubes and continuing to expand and retract said first tubes and then said second tubes continuously impart motion to said elastic layer, the expanding and retracting of the first and second tubes occurring by expanding and retracting the respective first and second portions.

8. A method of imparting continuous motion to a elastic layer for supporting a person wherein said elastic layer has a plurality of rows of spaced apart elongated tubes embedded in said elastic layer with each of said tubes being expandable by the injection of gas therein and retractable upon the release of gas from said tubes, each of said tubes having a first portion and a second portion, with the first portion and the second portion forming a chamber therebetween, the first portion capable of moving with respect to the second portion as the tubes expand and retract, the first and second portions being independent and distinct from each other, comprising the steps of:

sequentially injecting and releasing gas to and from a first set of alternate rows of tubes and to and from a second set of alternate rows of tubes for imparting motion to said elastic layer, the expanding and retracting of the tubes occurring by expanding and retracting the respective first and second portions.

9. An elastic layer for supporting a person comprising:

an elastic matrix comprising upper and lower sides, a first set of opposite edges and second set of opposite edges, a plurality of rows of spaced apart elongated tubes embedded in said elastic matrix with each of said tubes being expandable and retractable for imparting continuous motion to said elastic matrix, a first set of air tubes extending to a first set of alternate rows of said elongated tubes for the passage of air into and out of said first set of alternate rows of said elongated tubes for causing said first set of alternate rows of said elongated tubes to expand and retract, a second set of air tubes extending to a second set of alternate rows of said elongated tubes for the passage of air into and out of said second set of alternate rows of said elongated tubes for causing said second set of alternate rows of said elongated tubes to expand and retract, each of said first and second sets of air tubes having a first portion and a second portion, with the first portion and the second portion forming a chamber therebetween, the first portion capable of moving with respect to the second portion as the air tubes expand and retract, the first and second portions being independent and distinct from each other.

10. The elastic layer of claim 9, wherein:

said first set of opposite edges are transverse to said second set of opposite edges, said plurality of rows of spaced apart elongated tubes are generally parallel to one of said sets of opposite edges.

11. The elastic layer of claim 10, wherein said elongated tubes are formed of a material different from the material of said elastic matrix.

12. The elastic layer of claim 9, wherein said elongated tubes are formed of a material different from the material of said elastic matrix.

* * * * *